United States Patent [19]

Seaberg

[11] 4,230,434

[45] Oct. 28, 1980

[54] LIFT TRUCK LOAD-HANDLING ATTACHMENT HAVING INTEGRAL QUICK-DISCONNECT HOOK

[75] Inventor: Richard D. Seaberg, Vancouver, Wash.

[73] Assignee: Cascade Corporation, Portland, Oreg.

[21] Appl. No.: 69,599

[22] Filed: Aug. 24, 1979

[51] Int. Cl.[3] ..... B66F 9/075

[52] U.S. Cl. ..... 414/607; 292/207; 403/407

[58] Field of Search ..... 414/607, 608, 723, 724; 403/316, 317, 406, 407, 408, DIG. 4; 292/54, 207, 208

[56] References Cited

U.S. PATENT DOCUMENTS

| | | | |
|---|---|---|---|
| 1,253,810 | 1/1918 | Gianninoto | 292/207 |
| 2,368,122 | 1/1945 | Dunham | 414/607 |
| 2,581,364 | 1/1952 | Cushman | 414/607 |
| 3,797,687 | 3/1974 | Silva | 414/607 |

FOREIGN PATENT DOCUMENTS

| | | | |
|---|---|---|---|
| 25758 | of 1911 | United Kingdom | 292/207 |

*Primary Examiner*—James L. Rowland
*Attorney, Agent, or Firm*—Chernoff & Vilhauer

[57] ABSTRACT

A lift truck load-handling attachment having an integral quick-disconnect hook for permitting quick mounting or demounting of the attachment on a lift truck carriage. The hook comprises a lug for engaging the lower attachment mounting bar of the lift truck carriage, the lug being permanently mounted rotatably upon a rearwardly-protruding stub shaft affixed permanently to the frame of the attachment. The lug may be rotated between an engaged position, in which it engages the lower support bar, and a disengaged position. A pin is slidably mounted for selectively locking the lug in its engaged position when the pin is in a first slidable position relative to the lug. In a second slidable position, the pin no longer obstructs rotation of the lug, permitting disengagement thereof from the lower support bar. The pin cannot be detached from the hook assembly or load-handling attachment under any condition, nor can it be moved to its first slidable position unless the rotatable lug is rotated to its engaged position.

10 Claims, 10 Drawing Figures

FIG. 3
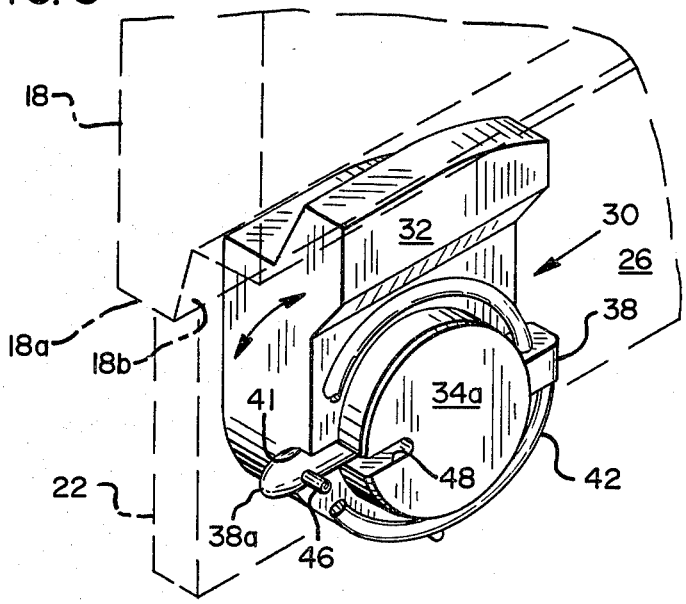
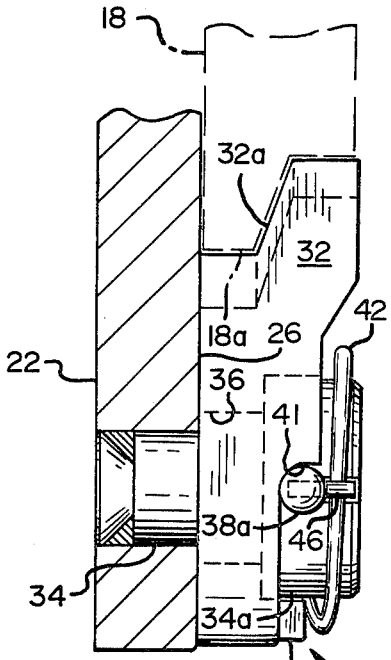
FIG. 5
FIG. 4
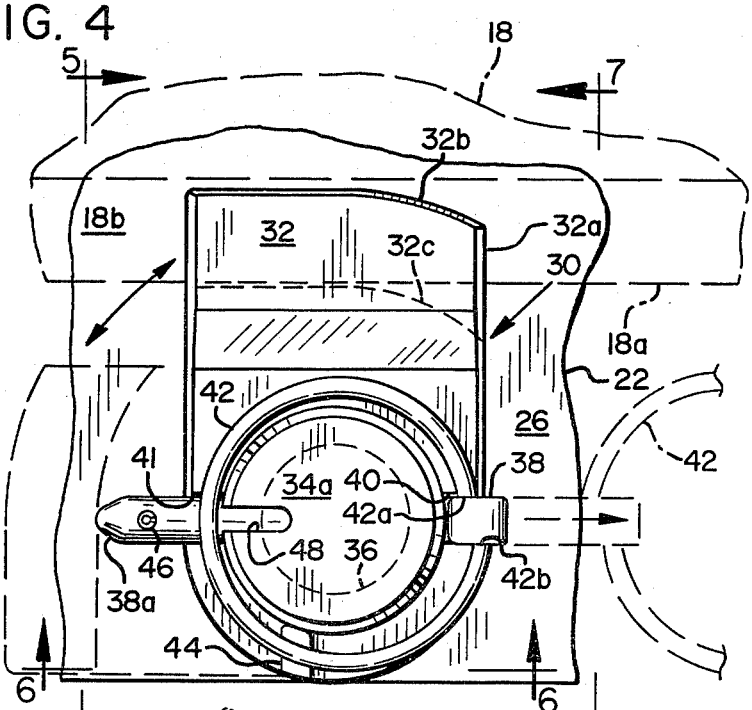
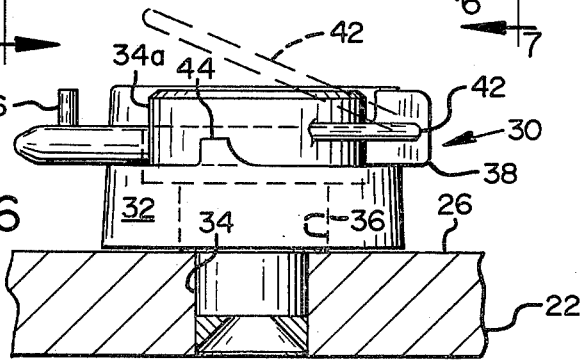
FIG. 6
FIG. 7
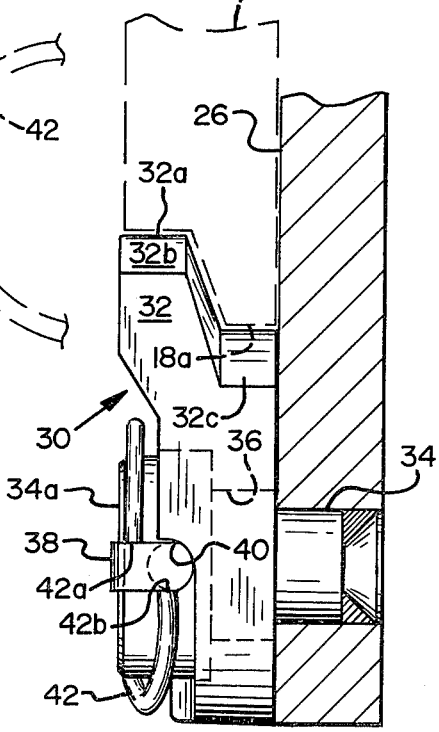

LIFT TRUCK LOAD-HANDLING ATTACHMENT HAVING INTEGRAL QUICK-DISCONNECT HOOK

BACKGROUND OF THE INVENTION

The invention relates to improvements in the structure by which a load-handling attachment is removably mounted upon a lift truck carriage so as to permit quick mounting or demounting of the attachment. Such mounting or demounting of load-handling attachments is a common occurrence in the materials handling industry, owing to the different nature of various types of loads to be handled each requiring different load-handling apparatus such as load forks, paper roll clamp, carton clamp, push-pull attachment etc. Since a lift truck is a highly versatile machine capable of handling any of such loads depending upon the load-handling attachment with which the truck is equipped, standardized mating assemblies to facilitate quick interchangeability of load-handling attachments are provided on the front surface of lift truck load carriages and on the rear surface of load-handling attachments. These take the form of upper and lower horizontal bars on the front of the lift truck carriage, having upwardly and downwardly protruding lips respectively, which matingly engage upper and lower hook assemblies mounted on the rear of the load-handling attachment. The upper hook assembly is normally fixed permanently and immovably to the load-handling attachment, making it necessary that the lower hook assembly, normally comprising a pair of transversely-spaced hooks, be removably mounted to the rear of the load-handling attachment by bolts. During mounting of the attachment, after the upper hook assembly has engaged the upper bar of the load carriage the lower hooks can be bolted into place on the rear side of the downwardly-protruding lip of the lower carriage bar. For demounting, conversely, the lower hooks are unbolted and removed first.

The removable lower hooks currently used on load-handling attachments have certain significant drawbacks. One such disadvantage stems from the detachability of the hooks and bolts from the load-handling attachment, creating loose parts which may easily become misplaced or separated from their attachments during an attachment exchange procedure, particularly if there is any substantial time lapse between the demounting and remounting of a particular attachment.

A further disadvantage of most lower hooks is the requirement for tools (i.e. wrenches) to remove and attach the hooks, which tools may not be readily available at the time and place where needed thereby causing delay and resultant lost production time for the lift truck. Some lower hook assemblies have been devised wherein the hooks may be rotated from positions engaging the lower carriage bar downwardly to disengaged positions, without requiring removal of the hooks, by removing a slidable pin which locks the rotatable hooks in the engaged position. However, the removable pin suffers from the disadvantages outlined in the previous paragraph in that it is a loose part which may easily become displaced or separated from the attachment.

In addition, both the removable hooks and those featuring removable pins are susceptible to negligence on the part of a workman during mounting of an attachment in that it is possible to place the hooks in their engaged positions without it being necessarily noticeable that the hook bolts are not tightened sufficiently or that a removable pin has not been inserted properly. Accordingly the hook and/or removable pin may be able to work itself loose without detection during subsequent operation of the attachment due to repeated vibrations, and impacts.

SUMMARY OF THE PRESENT INVENTION

The present invention is directed to a load-handling attachment having a lower hook structure which obviates all of the above disadvantages of current lower hook structures.

The previous problem with respect to loose parts is obviated by providing a lower hook assembly which includes a lug or lugs permanently connected rotatably to the rear of the attachment frame by a rearwardly-protruding stub shaft or bolt which requires no manipulation during engagement or disengagement of the hook assembly. In one rotatable position the lugs lockingly engage the downwardly-protruding lip of the lower carriage bar, and the lugs may be selectively rotated from such engagement to another position free of the lip thereby permitting mounting or demounting of the attachment. A locking assembly for selectively locking the lug or lugs to prevent rotation thereof from the engaged position is also provided, such locking assembly also being permanently connected to the attachment frame. Preferably the locking assembly comprises pins slidably mounted transversely through the lugs or through the shafts upon which the lugs are rotatably mounted so as to prevent rotation of the lugs when the lugs are in their engaged position and the pins are in a locking slidable position with respect to the lugs, and for permitting rotation of the lugs when the pins are in a second slidable position with respect thereto. Retainers on the pins prevent full slidable withdrawal or removal of the pins under any circumstances, thereby preventing the pins from becoming separated from the attachment and thus misplaced.

The pins and lugs can be manipulated manually, thereby obviating the need for tools of any kind. Moreover, to minimize the chance of inadvertently failing to lock the lugs in their engaged positions, two related features are provided. First, a structure is provided which makes it impossible to slide a pin to its locking position, relative to a lug, unless the respective lug has been rotated to its engaged position. Thus the position of the pin makes it visually obvious when the lug is not locked. Second, the pin itself is equipped with a selectively-operable locking feature which, when the pin is in its locking position, prevents sliding movement of the pin. Conversely, when the pin is not in such position, the pin cannot be locked which also makes it visually obvious that the pin is not in proper position for locking the lug.

Accordingly, it is a primary objective of the present invention to provide a lift truck load-handling attachment having a lower hook assembly, all parts of which remain integrally connected to the load-handling attachment during selective engagement or disengagement of the hook assembly with respect to the lift truck carriage.

Further objectives of the present invention are to provide such a hook assembly which requires no tools to engage or disengage the hook, and to provide a hook locking mechanism which renders it visually obvious when the hook is not locked in its engaged position.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 3 is a rear perspective view of the hook assembly of FIG. 2 in its engaged position.

FIG. 4 is a rear view of the hook assembly of FIG. 2 in its engaged position, its disengaged position being shown in phantom.

FIG. 5 is a side view of the hook assembly of FIG. 2 taken along line 5—5 of FIG. 4.

FIG. 6 is a bottom view of the hook assembly of FIG. 2, taken along line 6—6 of FIG. 4.

FIG. 7 is a side view of the hook assembly of FIG. 2, taken along line 7—7 of FIG. 4.

DESCRIPTION OF THE PREFERRED EMBODIMENTS

First Embodiment

Figure 1:
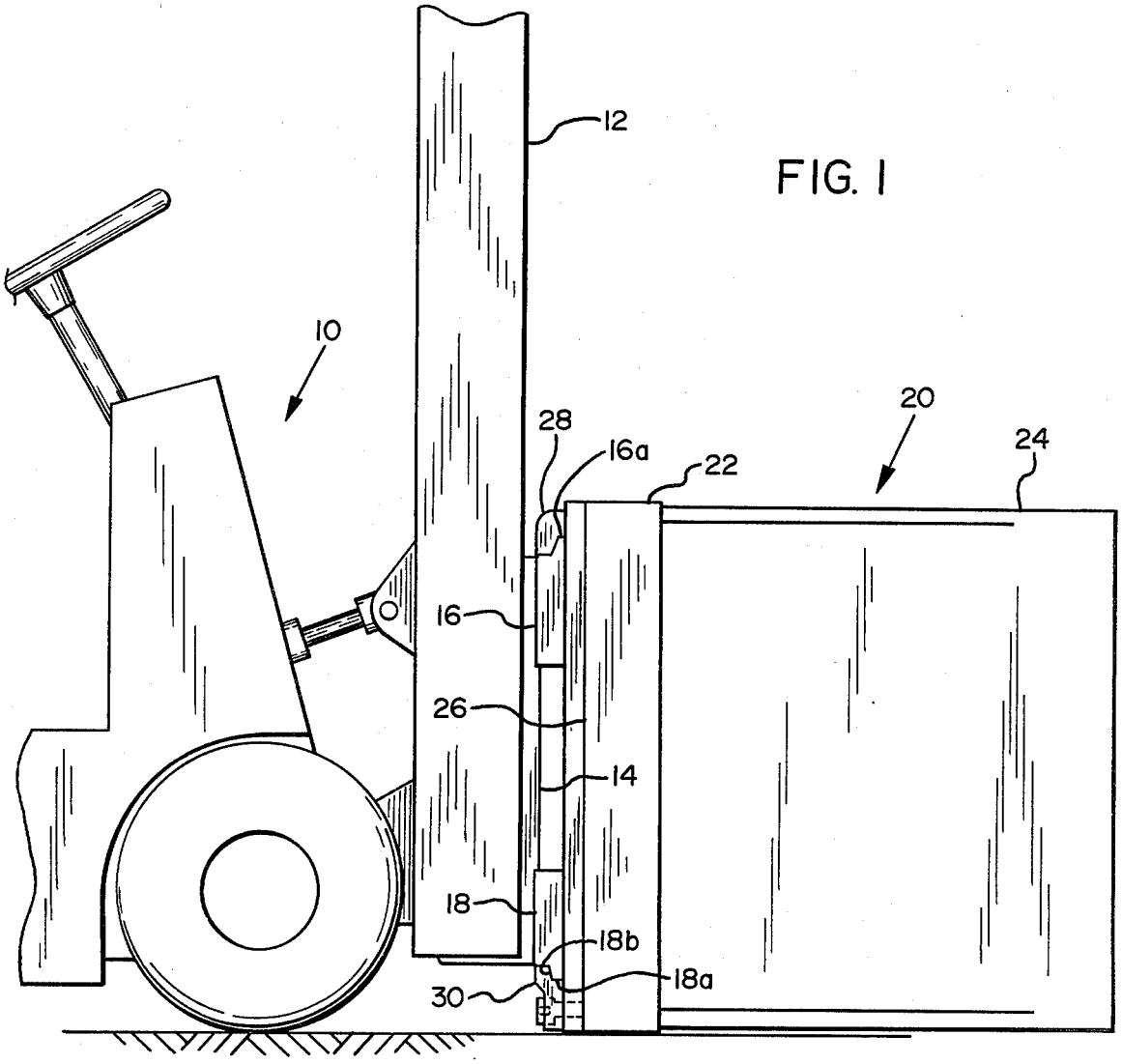
FIG. 1 is a partial, simplified side view of a lift truck equipped with a load-handling attachment having a quick-disconnect hook in accordance with the present invention.

With reference to FIG. 1, a lift truck 10 is depicted having a load-lifting mast 12 mounted at the front thereof. Mounted upon the mast 12 and vertically movable with respect thereto is a load carriage 14 having upper and lower horizontal attachment mounting bars 16 and 18 respectively affixed to the front thereof, bar 16 having an upwardly-extending lip **16*a* and bar 18 having a downwardly-extending lip 18*a*. A load-handling attachment, designated generally as 20, comprises a frame 22 upon which are mounted forwardly-extending load-handling members which may be of any suitable type, such as a pair of clamp arms 24, only one of which is shown. Mounted upon the rearwardly-facing surface 26 of the attachment frame 22 are a downwardly-facing fixed upper hook 28 for matingly engaging lip 16*a*, and a lower hook 30 (preferably a transversely-spaced pair of them, although only one is shown) pivotally attached to the frame 22 so as to rotate about an axis extending generally from the front to the rear thereof for selectively matingly engaging or disengaging the rearwardly-facing surface 18*b* of lip 18*a***.

Figure 2:
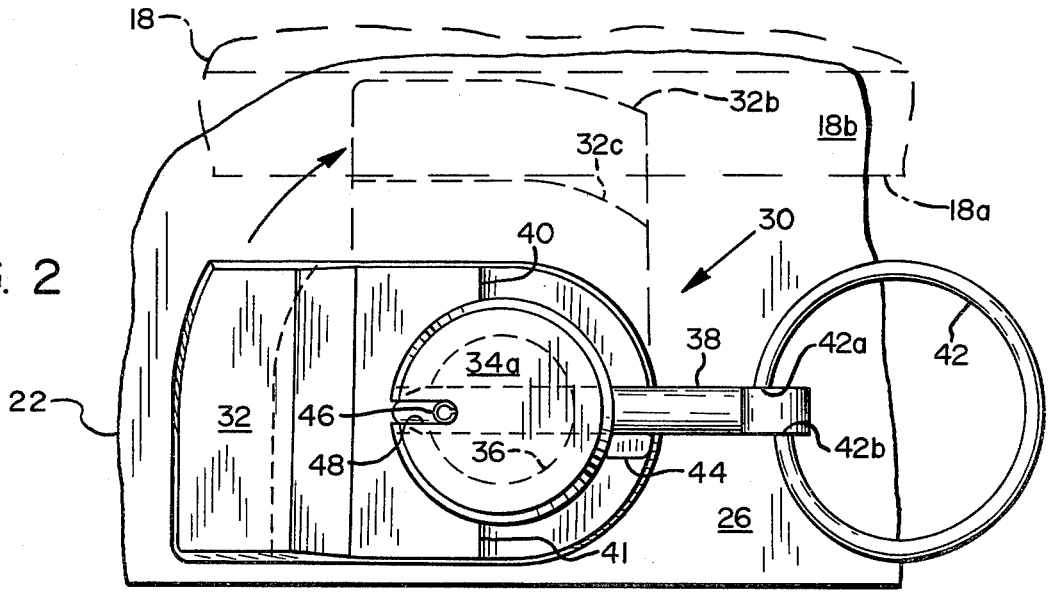
FIG. 2 is a rear view of one embodiment of the hook assembly shown in its disengaged position for demounting of the load-handling attachment, its engaged position being shown in phantom.

The hook 30 is shown in greater detail in FIGS. 2–7, and comprises a lug 32 rotatable journaled and permanently mounted to the attachment frame 22 by a stub shaft 34. One end of the stub shaft is welded to the frame 22 and the other end contains an enlarged, rearwardly-protruding head portion **34*a* which has a larger diameter than the aperture 36 of the lug 32 through which a reduced diameter portion of the stub shaft 34 passes. As best seen in FIGS. 2 and 4, the lug 32 has two rotatable positions relative to the frame 22 and stub shaft 34. In the rotatable position of the lug shown in FIG. 2, the lug does not engage the lip 18*a* of the lower carriage bar 18, whereas in the rotatable position shown in FIG. 4 an engagement portion or lip 32*a* of the lug 32 is rotated 90° upwardly from the position shown in FIG. 2 to a position behind the rearwardly-facing surface 18*b* of the lip 18*a*. In this latter rotatable position, the lug 32 prevents the attachment frame 22 from being pulled forwardly away from the lower carriage bar 18 by interference of the lug's engagement portion 32*a* with the rearwardly-facing surface 18*b* of the lip 18*a*. It is important to note that rotation of the lug 32, from the engaged position with the bar 18 as shown in solid lines in FIG. 4 to the disengaged position shown in solid lines in FIG. 2, is made possible by the provision of curved engagement surfaces 32*b* and 32*c*, respectively, which permit the rotation of the lug between its engaged and disengaged positions, respectively, without interference with the bar 18**.

The locking structure for retaining the lug 32 in its engaged position comprises a pin 38 slidably mounted transversely through the enlarged head portion **34*a* of the stub shaft 34 such that the lug 32 is positioned between the pin 38 and the frame 22. The pin 38 has a first slidable position as shown in FIG. 4 wherein it is fully inserted through the stub shaft and locks the lug 32 against rotation from its engaged position. The aforementioned locking occurs by means of a pair of shoulders 40 and 41 formed on the rear surface of the lug 32 in positions approximately diametrically opposed to one another so that the shoulders matingly engage the top of the pin 38 when the lug 32 is in its engaged position and the pin is fully inserted. It is important to note that, when the lug 32 is not in its engaged rotatable position as shown in FIG. 4, it is impossible for the pin 38 to be fully inserted to the slidable position shown in FIG. 4 since the end 38*a* of the pin will be unable to pass beneath the shoulder 41. Thus the pin 38 cannot be placed in its slidable locking position unless the lug 32** is in its engaged rotatable position.

The head of the pin 38 has a bail 42 hingedly attached thereto for selectively engaging or disengaging the head portion **34*a* of the stub shaft. In the fully-inserted locking position of the pin 38, the bail encircles the protruding head portion as shown in FIGS. 3–7, thereby preventing any sliding movement of the pin from its fully-inserted locking position. The bail 42 is spring-loaded to forcibly urge the bail toward its position encircling the stub shaft by the well-known expedient of utilizing offset hinge points 42*a* and 42*b* where the bail connects to the pin 38**. Such spring loading prevents inadvertent detachment of the bail from the stub shaft despite the effect of vibrations or impacts to which the attachment may be subjected.

Unlocking of the lug 32 from its engaged position as shown in FIGS. 3–7 is accomplished by partial slidable withdrawal of the pin 38 from the stub shaft 34 to the position shown in solid lines in FIG. 2. In such partially withdrawn position, the shoulder 41 of the lug 32 no longer engages the top of the pin 38, and the lug is free to rotate 90° counter-clockwise from its engaged position to the disengaged position shown in solid lines in FIG. 2. Further rotation of the lug is prevented by interference of a small protrusion 44, located on the rear surface of the lug 32, with the bottom of the pin 38. To enable such partial withdrawal of the pin, it is necessary to lift the hinged bail 42, as shown in dotted lines in FIG. 6, to clear the protruding head portion **34*a* of the stub shaft 34. With the pin 38 in its partially withdrawn, or unlocking, position, it is impossible to snap the bail 42 down to a position encircling the stub shaft 34. This, coupled with the partially withdrawn position of the pin 38**, makes it visually obvious to any worker that the lug is not locked.

Complete withdrawal of the pin 38 from the stub shaft 34 is prevented at all times by a small keeper pin 46 transversely affixed permanently to the end 38*a* of the pin 38. The keeper pin enters a slot 48 formed in the head portion 34*a* of the stub shaft to permit sufficient partial withdrawal of the pin to clear the shoulder 41, but prevents further withdrawal of the pin 38.

Second Embodiment

Figure 8:
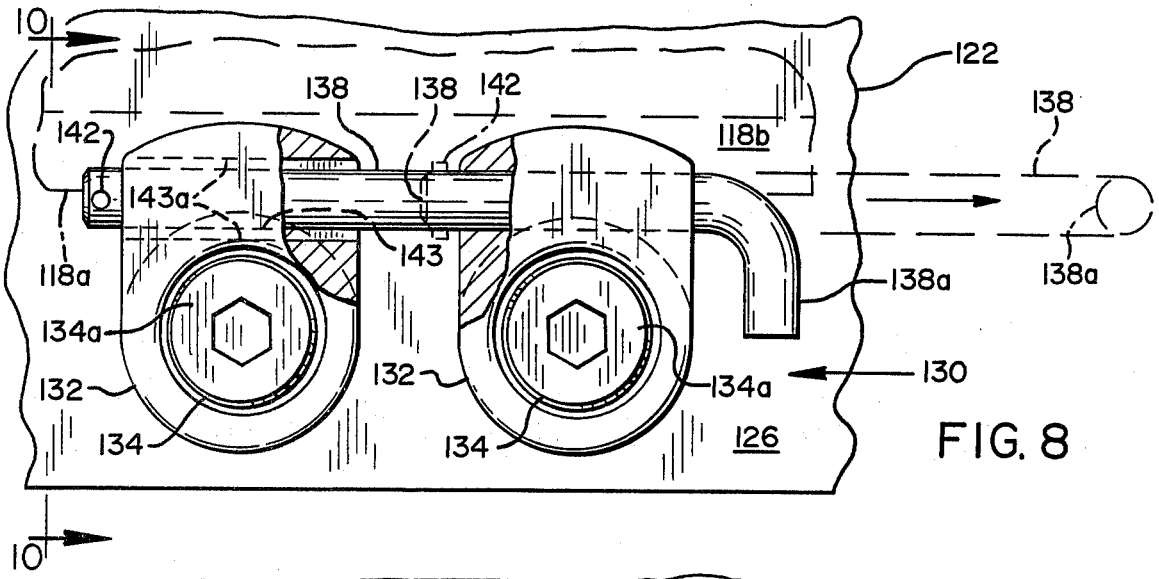
FIG. 8 is a rear view of a second embodiment of the hook assembly shown in its engaged position.
Figure 9:
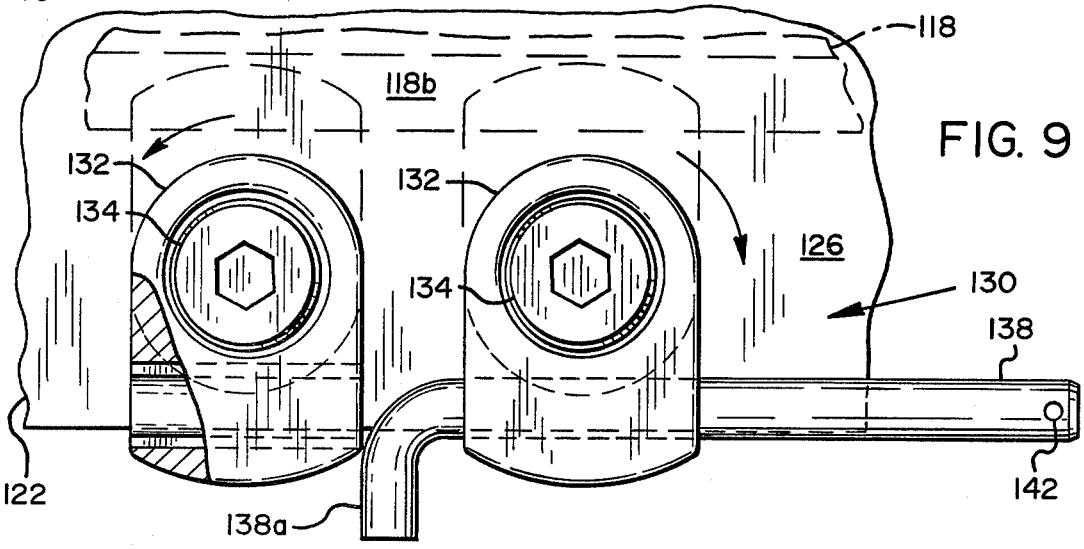
FIG. 9 is a rear view of the hook assembly of FIG. 8 shown in its disengaged position.
Figure 10:
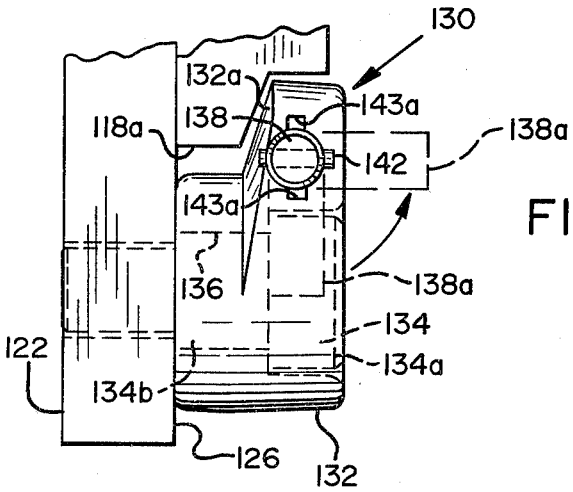
FIG. 10 is an end view taken along line 10—10 of FIG. 8.

FIGS. 8 through 10 depict a second embodiment of a lower hook assembly which satisfies all of the basic objectives discussed previously. The hook assembly 130 comprises a pair of lugs 132 in side-by-side relation rotatably mounted upon the rearwardly-facing surface 126 of an attachment frame 122 for selectively matingly engaging or disengaging the rearwardly-facing surface 118*b* of lip 118*a* of the load carriage's lower horizontal attachment mounting bar 118. Preferably two pairs of lugs 132 are provided, transversely spaced on either side of the rearwardly-facing surface 126 of the attachment frame 122.

Each lug 132 is rotatably journaled to the attachment frame 122 by a bolt 134. One end of the bolt 134 is tightly threaded into the frame 122 and the other end contains an enlarged head portion 134*a* which has a larger diameter than the aperture 136 of the lug 132 through which a reduced diameter portion 134*b* of the bolt passes and about which the lug 132 is manually rotatable.

In the upwardly-rotated positions of the lugs 132 shown in FIG. 8, an engagement portion or lip 132*a* of each lug 132 is positioned behind the rearwardly-facing surface 118*b* of the lip 118*a*, thereby preventing the attachment 122 from being pulled forwardly away from the lower carriage bar 118 by interference of the lug's engagement portion 132*a* with the lip 118*a*. In the downwardly-rotatable positions of the lugs 132 shown in FIG. 9, the lugs do not engage the lip 118*a* of the lower carriage bar 118.

The locking structure for retaining the lugs 132 in their engaged positions comprises a pin 138 slidably and permanently mounted transversely through one of the lugs 132 (i.e. the right-hand lug in the figures) and having a first slidable position as shown in solid lines in FIG. 8 wherein it is fully inserted through the left-hand lug 132 locking both lugs against rotation from their engaged positions. When both lugs 132 are not in the fully-engaged rotatable positions shown in FIG. 8, it is impossible for the pin 138 to be inserted into the left-hand lug to the slidable position shown in FIG. 8.

One end of the pin 138 has a keeper pin 142 permanently inserted transversely therethrough for selectively preventing or permitting withdrawal of the pin 138 from the left-hand lug 132. It accomplishes this function in cooperation with a keyed aperture 143 in the left-hand lug having upper and lower keyways 143*a* through which the pin 138 can pass for full insertion into its locking position. For such insertion, the pin 138 must be rotated 90° from its position shown in FIG. 8 (see phantom position in FIG. 10) such that the protruding ends of the keeper pin 142 pass slidably through the keyways 143*a*. After the pin 138 has been fully inserted through the keyed aperture 143, the pin 138 may then be rotated 90° downwardly to the position shown in FIG. 8, thereby rotating the keeper pin 142 perpendicularly to the keyways 143*a* and preventing withdrawal of the pin 138. The pendulum effect of the L-shaped head 138*a* of the pin 138 utilizes the force of gravity to urge the keeper pin 142 toward its locked orientation shown in FIGS. 8 and 10 and thereby retain it in such orientation despite the mechanical vibrations, jolts, etc. to which the attachment may be subjected, thereby preventing any inadvertent withdrawal of the pin 138 from its locked position.

Unlocking of the lugs 132 from their engaged positions as shown in FIGS. 8 and 10 to their disengaged positions as shown in FIG. 9 is accomplished by withdrawal of the pin 138 from the left-hand lug 132 to the position shown in phantom in FIG. 8. It will be noted that the aperture in the right-hand lug through which the pin 138 is slidably inserted does not have keyways such as 143*a* and thereby prevents the slidable withdrawal of the pin 138 therefrom regardless of the rotational orientation of the pin. Accordingly, only withdrawal of the pin 138 sufficient to clear the left-hand lug 132 is permitted, further withdrawal of the pin 138 from the right-hand lug being prevented by the keeper pin 142. When the pin 138 has been withdrawn from the left-hand lug 132, it is possible to rotate both lugs 132 downwardly into the disengaged positions shown in FIG. 9. In such disengaged positions the pin 138 remains attached to the attachment frame 122 and cannot be separated therefrom.

It will be noted that in all unlocked positions of the pin 138, the unlocked condition is visually obvious. Even when the pin 138 is almost, but not fully, inserted through the keyed aperture 143 of the left-hand lug 132, the unlocked condition of the pin 182 is obvious due to the inability of the pin to be rotated such that its L-shaped head 138*a* is in a depending orientation.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling attachment, adapted for mounting upon the front of a vertically-movable lift truck load carriage having an attachment mounting member thereon of the type which includes a lip having a rearwardly-facing surface, comprising: a frame with a rearwardly-facing surface adapted to abut against the front of said load carriage; hook means mounted upon the rearwardly-facing surface of said frame for selectively matingly engaging or disengaging said lip, said hook means comprising a lug pivotally attached to the rearwardly-facing surface of said frame so as to rotate about an axis extending generally from the front to the rear of said frame, said lug having engagement means for matingly engaging the rearwardly-facing surface of said lip when said lug is in a predetermined rotatable position relative to said frame; locking means attached to said hook means and said frame for selectively locking said lug, to prevent rotation thereof from said predetermined rotatable position, or unlocking said lug so as to permit rotation thereof; and means interconnecting said locking means with said frame for preventing detachment of said locking means from said frame during selective locking and unlocking of said lug by said locking means.

2. The apparatus of claim 1 including rearwardly-protruding shaft means attached to said frame for pivotally journaling said lug thereon, and means attaching said lug to said shaft means for permitting selective rotation of said lug without detachment of said lug from said shaft means while said lug is unlocked by said locking means.

3. The apparatus of claim 1, further including means for preventing said locking means from locking said lug, to prevent rotation thereof, in any rotatable position of said lug other than said predetermined rotatable position.

4. The apparatus of claim 3 wherein said locking means has a first position for locking said lug to prevent rotation thereof from said predetermined rotatable position and a second position for unlocking said lug to permit rotation thereof, further including selectively operable means for selectively preventing movement of said locking means from said first position to said second position thereof, said selectively operable means having a first position relative to said lug wherein it prevents, and a second position relative to said lug wherein it permits, movement of said locking means from said first position thereof to said second position thereof.

5. The apparatus of claim 4 including means for exerting a force on said selectively operable means urging said selectively operable means toward said first position thereof.

6. The apparatus of claim 4 further including means for preventing said selectively operable means from being moved to its first position relative to said lug when said locking means is not in its first position.

7. A load-handling attachment, adapted for mounting upon the front of a vertically-movable lift truck load carriage having an attachment mounting member thereon of the type which includes a lip having a rearwardly-facing surface, comprising: a frame with a rearwardly-facing surface adapted to abut against the front of said load carriage; hook means mounted upon the rearwardly-facing surface of said frame for selectively matingly engaging or disengaging said lip, said hook means comprising a lug pivotally attached to the rearwardly-facing surface of said frame so as to rotate about an axis extending generally from the front to the rear of said frame, said lug having engagement means for matingly engaging the rearwardly-facing surface of said lip when said lug is in a predetermined rotatable position relative to said frame; locking means attached to said frame for selectively locking said lug, to prevent rotation thereof from said predetermined rotatable position, or unlocking said lug so as to permit rotation thereof; and means for preventing said locking means from locking said lug, to prevent rotation thereof, in any rotatable position of said lug other than said predetermined rotatable position.

8. The apparatus of claim 7 wherein said locking means has a first position for locking said lug to prevent rotation thereof from said predetermined rotatable position and a second position for unlocking said lug to permit rotation thereof, further including selectively operable means for selectively preventing movement of said locking means from said first position to said second position thereof, said selectively operable means having a first position relative to said lug wherein it prevents, and a second position relative to said lug wherein it permits, movement of said locking means from said first position thereof to said second position thereof.

9. The apparatus of claim 8 including means for exerting a force on said selectively operable means urging said selectively operable means toward said first position thereof.

10. The apparatus of claim 8 further including means for preventing said selectively operable means from being moved to its first position relative to said lug when said locking means is not in its first position.

* * * * *